US005722180A

United States Patent [19]

Joiner

[11] Patent Number: 5,722,180

[45] Date of Patent: Mar. 3, 1998

[54] APPARATUS FOR DRYING A WET PAPER WEB

[75] Inventor: John R. Joiner, Vancouver, Wash.

[73] Assignee: Fort James Corporation, Richmond, Va.

[21] Appl. No.: 707,798

[22] Filed: Sep. 4, 1996

[51] Int. Cl.[6] ..... F26B 11/02

[52] U.S. Cl. ..... 34/115; 34/114; 34/122

[58] Field of Search ..... 34/108, 114, 115, 34/122

[56] References Cited

U.S. PATENT DOCUMENTS

| | | |
|---|---|---|
| 1,453,645 | 5/1923 | Vedder . |
| 1,498,418 | 6/1924 | Ayres et al. . |
| 2,189,915 | 2/1940 | Mellor et al. . |
| 2,878,583 | 3/1959 | Spooner . |
| 3,043,018 | 7/1962 | Fleissner . |
| 3,303,576 | 2/1967 | Sisson . |
| 3,432,936 | 3/1969 | Cole et al. . |
| 3,609,872 | 10/1971 | Fleissner . |
| 3,821,068 | 6/1974 | Shaw . |
| 3,828,589 | 8/1974 | Collinge . |
| 3,945,131 | 3/1976 | Kusters et al. . |
| 4,753,693 | 6/1988 | Street . |
| 4,835,880 | 6/1989 | Vecchia . |

*Primary Examiner*—John M. Sollecito
*Assistant Examiner*—Dinnatia Doster

[57] ABSTRACT

Apparatus for drying a wet web, such as a wet paper web, includes a through air dryer roll. A rotatable fan member having fan blades is located within the through air dryer roll interior at one end of the through air dryer roll. Rotation of the fan member causes air flow through a web on the through air dryer roll, through openings of the through air dryer roll into the through air dryer roll interior, through the end of the through air dryer roll accommodating the fan member, and through an air flow passageway to the exterior of the through air dryer roll.

15 Claims, 5 Drawing Sheets

APPARATUS FOR DRYING A WET PAPER WEB

TECHNICAL FIELD

This invention relates to an apparatus for drying a wet web. The apparatus is particularly applicable for through air drying a wet paper web during manufacture thereof.

BACKGROUND ART

Through air dryers are well known expedients for drying wet paper webs, particularly tissue webs, conventionally employing a through air dryer roll for supporting and transporting the wet paper web and a through air dryer hood cooperable with the through air dryer roll to cause the passage of hot air through the through air dryer roll and the wet paper web thereon to dry the wet paper web. Through air dryers are shown, for example, in U.S. Pat. No. 3,303,576, issued Feb. 14, 1967, U.S. Pat. No. 3,432,936, issued Mar. 18, 1969, and U.S. Pat. No. 3,821,068, issued Jun. 28, 1974.

The following U.S. Patents are also considered relevant to the art of drying web materials, including the through air drying of such materials: U.S. Pat. No. 4,835,880, issued Jun. 6, 1989, U.S. Pat. No. 4,753,693, issued Jun. 28, 1988, U.S. Pat. No. 3,945,131, issued Mar. 23, 1976, U.S. Pat. No. 3,828,589, issued Aug. 13, 1974, U.S. Pat. No. 3,609,872, issued Oct. 5, 1971, U.S. Pat. No. 3,043,018, issued Jul. 10, 1962, U.S. Pat. No. 2,878,583, issued Mar. 24, 1959, U.S. Pat. No. 2,189,915, issued Feb. 13, 1940, U.S. Pat. No. 1,498,418, issued Jun. 17, 1924, and U.S. Pat. No. 1,453,645, issued May 1, 1923.

DISCLOSURE OF INVENTION

Through air dryers employed in paper manufacture suffer from a number of deficiencies. Such arrangements typically employ bulky duct work. This results in high capital costs, fan pressure loss and the requirement that a considerable amount of physical space must be utilized. Conventional through air dryer fans are themselves bulky and difficult to locate close to paper machines.

The present invention eliminates the requirement for a bulky off machine fan and duct runs are either eliminated all together or drastically reduced. There is less pressure across the seal between the rotating roll and stationary ductwork as compared to prior art arrangements.

The apparatus disclosed herein is described as drying a wet paper web; however, the invention is applicable for drying other types of webs as well.

The apparatus of the present invention includes a through air dryer roll for supporting a wet web while the wet web is being dried. The through air dryer roll has a double-ended cylindrical through air dryer roll wall with openings therein and defines a through air dryer roll interior communicating with the exterior of the through air dryer roll through the openings.

Through air dryer roll rotating means is provided for rotating the through air dryer roll.

A rotatable fan member having fan blades is located within the through air dryer roll interior and accommodated by an end of the through air dryer roll.

Fan member rotating means is provided for rotating the fan member within the through air dryer roll interior during rotation of the through air dryer roll by the through air dryer roll rotating means.

Air flow passageway defining means defines an air flow passageway between the fan member and the exterior of the through air dryer roll. The fan member upon rotation thereof by the fan member rotating means causes air flow through a web on the through air dryer roll through the openings of said through air dryer roll into the through air dryer roll interior, through the end of the through air dryer roll accommodating the fan member, and through the air flow passageway to the exterior of the through air dryer roll.

The air flow passageway defining means includes plenum defining means cooperable with the through air dryer roll to form a plenum located at the end of the through air dryer roll accommodating the fan member for receiving flowing air from the rotating fan member.

Other features, advantages, and objects of the present invention will become apparent with reference to the following description and accompanying drawings.

BEST MODE FOR CARRYING OUT THE INVENTION

Figure 1:
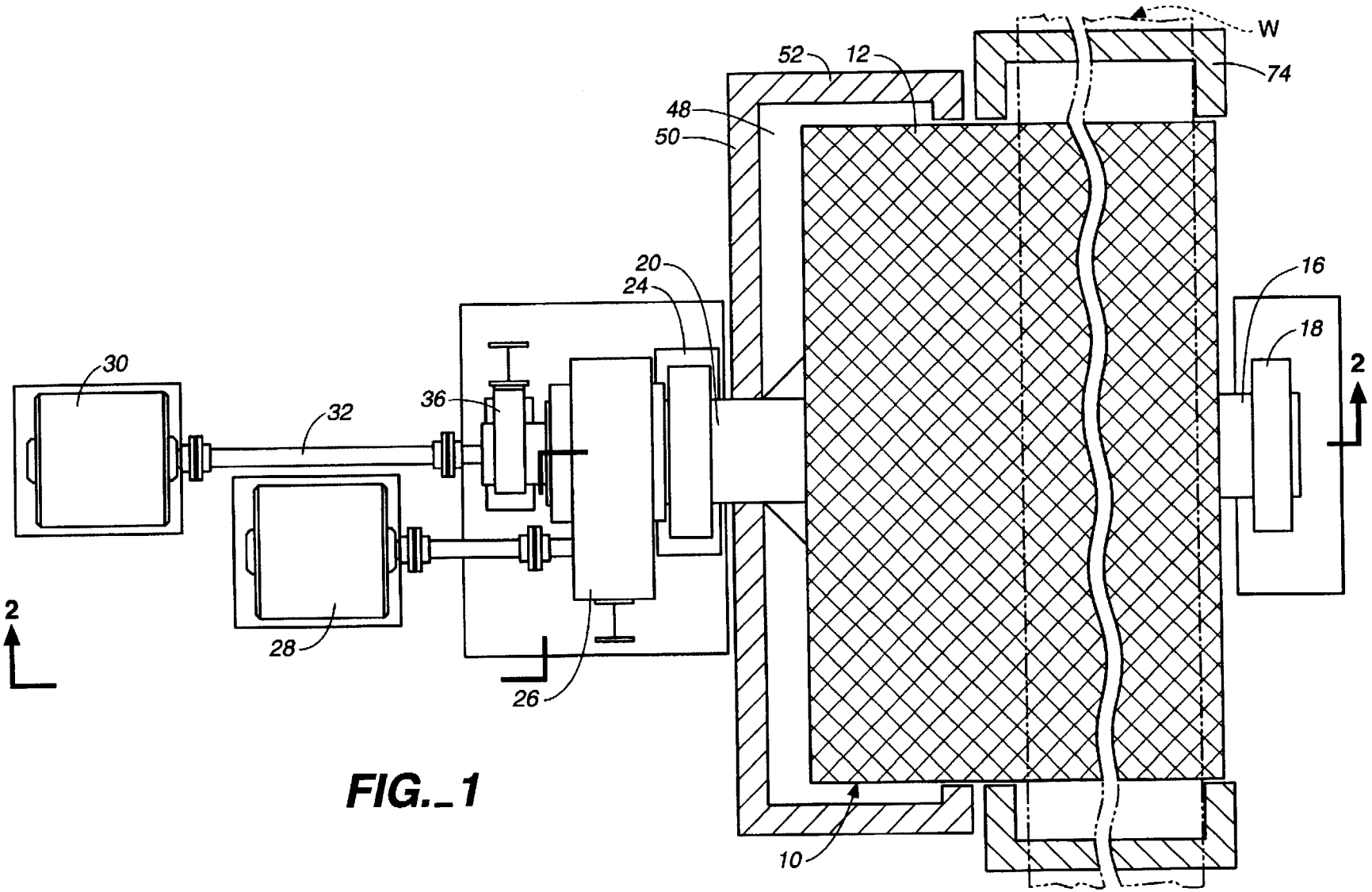
FIG. 1 is a somewhat simplified, diagrammatic, plan view of apparatus constructed in accordance with the teachings of the present invention.
Figure 2:
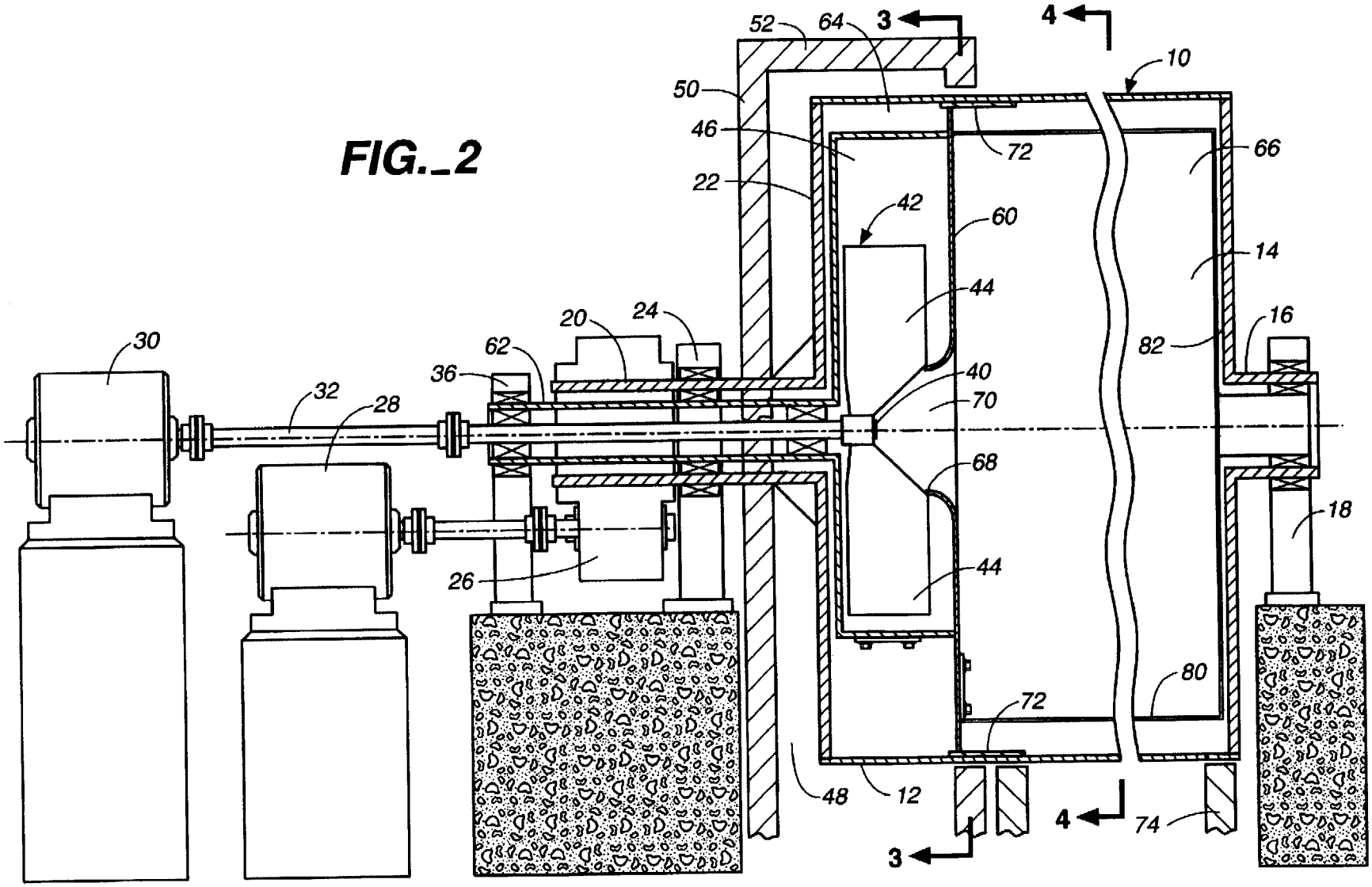
FIG. 2 is a cross-sectional view of the apparatus taken along the line 2—2 in FIG. 1.
Figure 3:
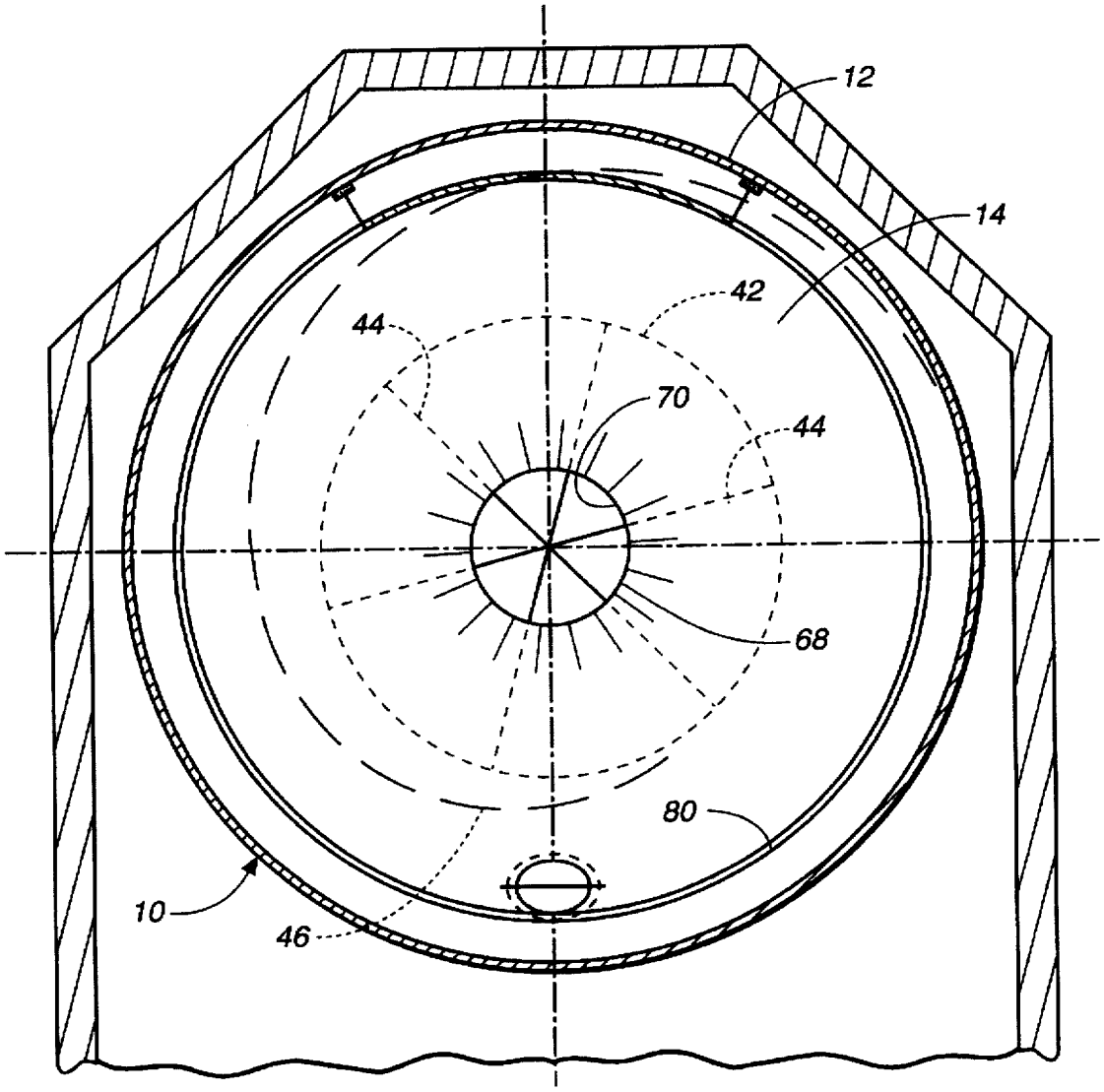
FIG. 3 is a cross-sectional view taken along the line 3—3 of FIG. 2.

Referring now to FIGS. 1 through 4, apparatus constructed in accordance with the teachings of the present invention is illustrated. The disclosed apparatus is for the purposes of drying a wet web such as wet paper web W (FIG. 4) and includes a through air dryer roll 10 for supporting the web while it is being dried.

Through air dryer roll 10 has a double-ended cylindrical through air dryer roll wall 12 having a plurality of openings therein. The through air dryer roll wall defines a through air dryer roll interior 14 communicating with the exterior of the through air dryer roll through the openings. The through air dryer roll construction just described is conventional.

A roll journal 16 supports the through air dryer roll 10 at one end thereof, the roll journal itself being rotatably journaled in a suitable support 18. Bearings inside roll journal 16 accommodate a stationary inner journal connected to an end plate affixed to stationary perforated air distribution plate 80, the latter being described in greater detail below. The other end of the through air dryer roll has an elongated support cylinder or spindle 20 projecting from a roll end wall 22. Support spindle 20 is hollow, defining a throughbore communicating with the interior 14 of the through air dryer roll.

Support spindle 20 is supported by a support 24 and projects into a gear box 26. A motor 28 drives the gears (not shown) in gear box 26 to rotate support spindle 20 and through air dryer roll 10.

Projecting from the output shaft of another motor 30 is a rotatable drive shaft 32 which extends through a fixed journal in the form of hollow tubular member 62 within support spindle 20, separated therefrom by bearings, and connected to an end wall or plate affixed to stationary air distribution plate 80. A torque arm 36 having bearings rotatably accommodates the drive shaft 32 between the motor 30 and the through air dryer roll 10 and cooperates with member 62 to prevent rotation of the air distribution plate and any connected related stationary internal structure. The distal end 40 of the drive shaft projects into the interior of the through air dryer roll 10.

Attached to drive shaft distal end 40 is a rotatable fan member 42 having a plurality of blades 44. In the arrangement illustrated, the fan member 42 is a centrifugal fan wheel. Leading away from the fan wheel is a scroll 46 which directs the air generated by rotating fan member 42 to a plenum 48. Plenum 48 is defined by a primary plenum wall 50 spaced from roll end wall 22 and a plenum side wall 52 which extends about and is closely adjacent to the through air dryer roll wall 12 at the end of the through air dryer roll accommodating fan member 42. As illustrated by phantom line in FIG. 1, the web W supported by the through air dryer roll 10 does not extend over that portion of the through air dryer roll encompassed by plenum side wall 52.

One side of the scroll 46 is defined by a partition 60 positioned within the through air dryer roll interior adjacent to the fan member 42. Partition 60 is supported along with the rest fixed against rotatable and axial movement. In other words, the tubular member 62 and structure including partition 60 supported thereby are immobile.

The partition 60 divides the through air dryer roll interior into a first interior section 64 within which fan member 42 is positioned and a second interior section 66.

Partition 60 includes a fan inlet bell 68 defining a partition opening 70. Opening 70 is centered with respect to the rotational axis of fan member 42. The distal end of the fan inlet bell curves inwardly toward the fan and is closely adjacent to the blades 44.

The immobile partition 60 has a circular outer periphery terminating closely adjacent to the through air dryer roll wall 12 and a circumferentially extending seal 72 minimizes airflow between the partition and the through air dryer roll wall.

Figure 4:
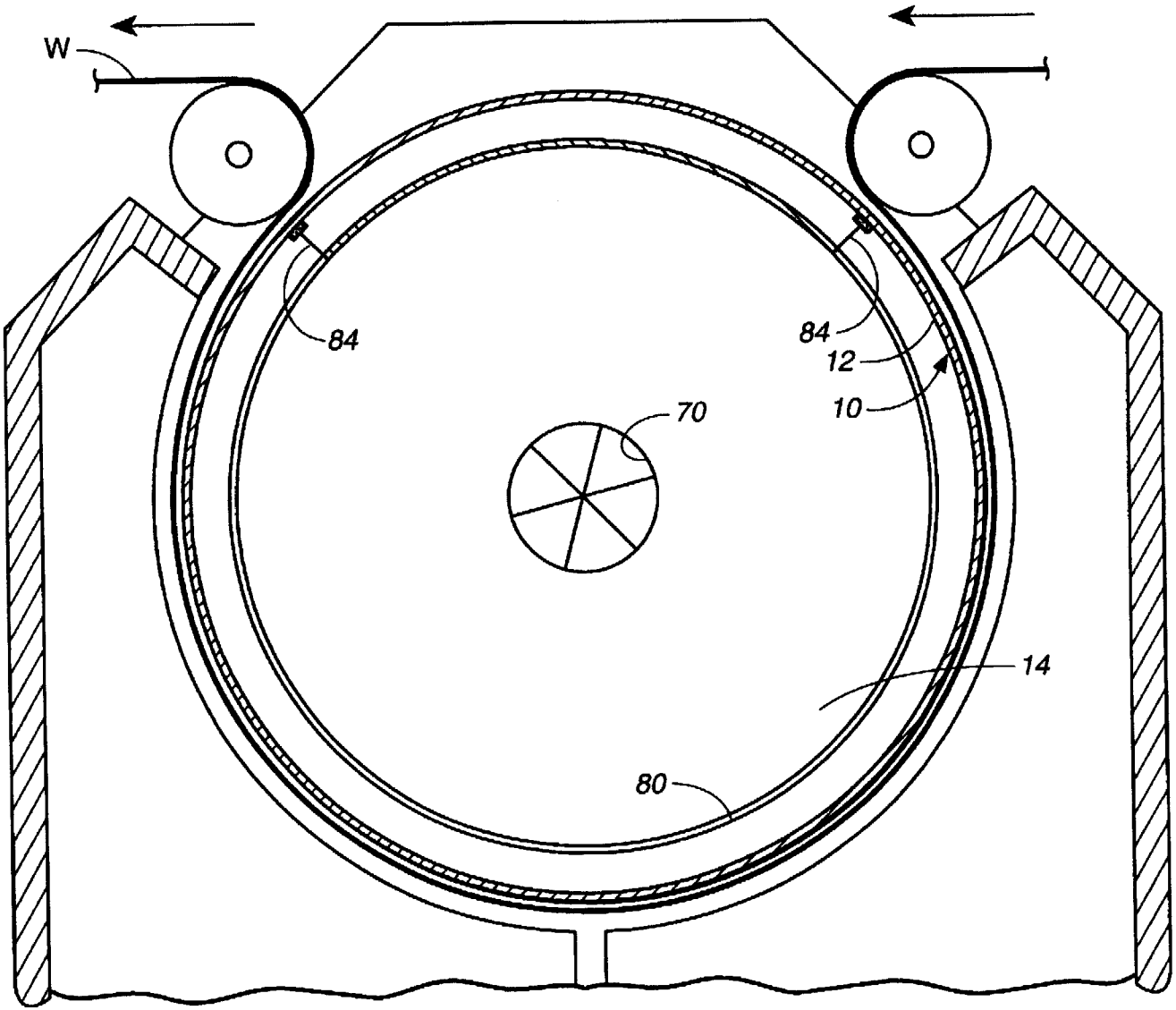
FIG. 4 is a cross-sectional view taken along the line 4—4 of FIG. 2.

That portion of the through air dryer roll 10 which corresponds to the second interior section thereof is positioned within a through air dryer hood 74 and the web W is within the confines of the hood as it is transferred by the through air dryer roll 10 through the hood. With reference to FIG. 4, a pair of rolls are illustrated to apply the web to the through air dryer roll and remove the web therefrom; however, use of rolls is not required when practicing the teachings of this invention.

A cylindrically-shaped air distribution plate 80 extends from partition 60 into the second interior section 66 of the through air dryer roll. The air distribution plate is immobile and spaced inwardly of the cylindrical through air dryer roll. The end of the distribution plate 80 at the end of the through air dryer roll not accommodating fan member 42 is closely adjacent to end wall 82 of the through air dryer wall. As stated above, the air distribution plate is supported by journals extending from affixed end plates or walls.

Most of the air distribution plate defines a plurality of openings allowing air flow therethrough. This air flow segment is the area bounded by and extending downwardly from two seal elements 84 providing a substantially airtight seal between the air distribution plate 80 and the through air dryer roll wall.

The top segment or portion of the air distribution plate (as seen in FIG. 4) between the seal elements 84 is solid so that air cannot readily flow through the distribution plate in such area nor through the through dryer roll except where the paper web being dried is engaged by the roll.

Although the disclosed embodiment illustrates a rotating fan at only one end of the through air dryer roll, it will be appreciated that such structure could be employed at both ends. The fans could be independently driven or interconnected to be driven simultaneously by a common prime mover. If desired, roll support 18 could be suspended from above to facilitate installation of an endless web support fabric as is common practice with tissue.

Figure 5:
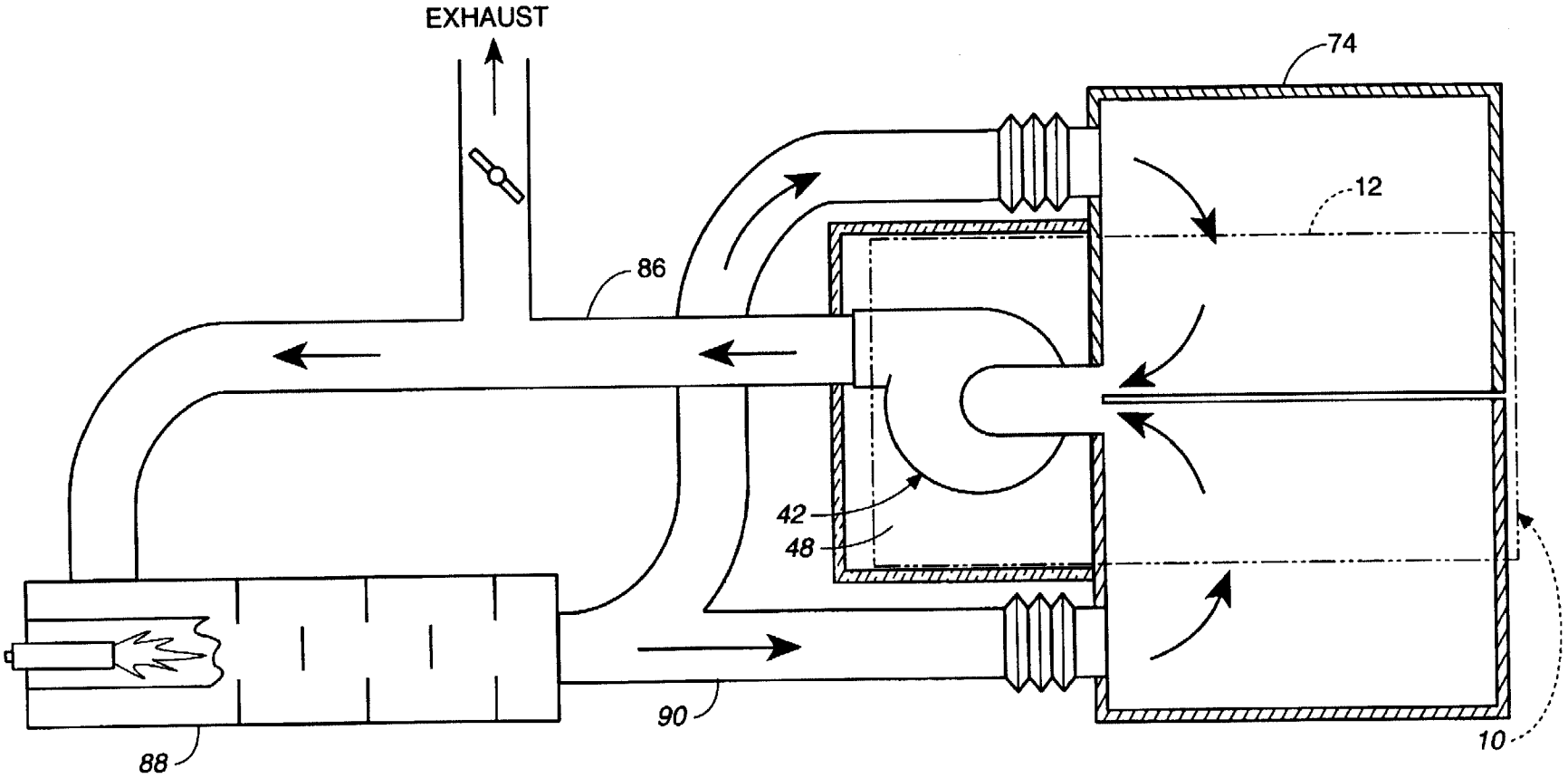
FIG. 5 is a schematic view illustrating the apparatus of the present invention in association with duct work and a combustion chamber and illustrating the flow of air through and between these structural components.

FIG. 5 provides a simplified diagrammatic illustration of the apparatus in combination with other structural elements in an operative environment. It will be seen that fan member 42 serves to pull air from the interior of the through air dryer roll and directs same through duct work 86 to a combustion chamber 88. The reheated air flows back into the interior of the through air dryer hood 74 through duct work 90, the reheated air flowing into the hood through two branches in the arrangement shown.

I claim:

1. Apparatus for drying a wet web, said apparatus comprising, in combination:

a through air dryer roll for supporting a wet web while said wet web is being dried, said through air dryer roll having a double-ended cylindrical through air dryer roll wall with openings therein and defining a through air dryer roll interior communicating with the exterior of said through air dryer roll through said openings;

through air dryer roll rotating means for rotating said through air dryer roll;

a rotatable fan member having fan blades located within said through air dryer roll interior accommodated by an end of said through air dryer roll;

fan member rotating means for rotating said fan member within said through air dryer roll interior during rotation of said through air dryer roll by said through air dryer roll rotating means; and air flow passageway defining means defining an air flow passageway between said fan member and the exterior of said through air dryer roll, said fan member upon rotation thereof by said fan member rotating means causing air flow through a web on the through air dryer roll, through the openings of said through air dryer roll into the through air dryer roll interior, through the end of said through air dryer roll accommodating said fan member, and through said air flow passageway to the exterior of said through air dryer roll.

2. The apparatus according to claim 1 wherein said air flow passageway defining means includes plenum defining means cooperable with said through air dryer roll to form a plenum located at the end of said through air dryer roll accommodating said fan member for receiving flowing air from said rotating fan member.

3. The apparatus according to claim 1 wherein said fan member and said through air dryer roll are co-axially rotatably mounted.

4. The apparatus according to claim 1 additionally comprising a partition positioned within said through air dryer roll interior adjacent to said fan member dividing said through air dryer roll interior into first and second interior sections, said fan member being positioned in said first interior section and said partition defining a partition opening allowing movement of flowing air from said second interior section into said first interior section upon rotation of said fan member by said fan member rotating means.

5. The apparatus according to claim 4 wherein said partition includes a fan inlet bell defining said partition opening, said fan inlet bell including a distal inlet bell end closely adjacent to said fan member.

6. The apparatus according to claim 4 wherein said partition has a circular outer periphery terminating closely adjacent to said through air dryer roll wall.

7. The apparatus according to claim 6 wherein said partition is fixedly positioned within the through air dryer roll interior and immobile.

8. The apparatus according to claim 7 additionally comprising seal means between said partition and said through air dryer roll.

9. The apparatus according to claim 1 wherein said air flow passageway defining means includes a through air dryer hood defining a hood interior accommodating at least a portion of said through air dryer roll.

10. The apparatus according to claim 7 additionally comprising a cylindrically-shaped air distribution plate extending from said partition into the second interior section of said through air dryer roll, said air distribution plate being immobile and spaced inwardly of said cylindrical through air dryer roll wall, said air distribution plate having a first segment defining a plurality of openings and a second segment having no openings formed therein, and spaced seal elements at the juncture of said first and second segments extending from said air distribution plate into sealing engagement with said cylindrical through air dryer roll wall.

11. The apparatus according to claim 1 wherein said fan member is an centrifugal fan wheel.

12. The apparatus according to claim 11 wherein said air flow passageway defining means includes a fan scroll leading from said centrifugal fan wheel.

13. The apparatus according to claim 2 wherein said through air dryer roll includes a roll end wall, said plenum defining means including a primary plenum wall spaced from said roll end wall and a plenum side wall connected to said primary plenum wall and having a distal plenum side wall end extending about and closely adjacent to said through air dryer roll wall at the end of the through air dryer roll accommodating said fan member.

14. The apparatus according to claim 1 additionally comprising a hollow through air dryer roll support spindle projecting from the end of the through air dryer roll accommodating said fan member, said support spindle being operatively associated with said through air dryer roll rotating means to rotate said through air dryer roll.

15. The apparatus according to claim 14 wherein said fan member rotating means includes a drive shaft connected to said fan member and extending through said support spindle.

* * * * *